US006682066B2

(12) United States Patent
Gunschera et al.

(10) Patent No.: US 6,682,066 B2
(45) Date of Patent: Jan. 27, 2004

(54) DELIVERY FOR A SHEET-PROCESSING MACHINE WITH A BRAKING AND SMOOTHING MACHANISM

(75) Inventors: Frank Gunschera, Nussloch (DE); Sven Kerpe, Eggenstein-Leopoldshafen (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 134 days.

(21) Appl. No.: 09/822,029

(22) Filed: Mar. 29, 2001

(65) Prior Publication Data

US 2001/0026043 A1 Oct. 4, 2001

(30) Foreign Application Priority Data

Mar. 29, 2000 (DE) ..... 100 15 704

(51) Int. Cl.[7] ..... B65H 29/68
(52) U.S. Cl. ..... 271/183; 271/182
(58) Field of Search ..... 271/183, 182

(56) References Cited

U.S. PATENT DOCUMENTS 2,969,980 A * 1/1961 Claybourn ..... 271/183
3,684,277 A * 8/1972 Buschmann ..... 271/183
4,119,309 A * 10/1978 Mayer et al. ..... 271/183
4,436,302 A * 3/1984 Frye et al. ..... 271/202
4,830,355 A * 5/1989 Jeschke ..... 271/183
5,909,873 A * 6/1999 Littleton ..... 271/183
6,098,976 A * 8/2000 Gieser et al. ..... 226/195
6,241,238 B1 * 6/2001 Aoki ..... 271/183

FOREIGN PATENT DOCUMENTS

DE 39 28 992 A1 3/1990
DE 197 33 692 A1 2/1999

* cited by examiner

*Primary Examiner*—Donald P. Walsh
*Assistant Examiner*—Jonathan R. Miller
(74) *Attorney, Agent, or Firm*—Laurence A. Greenberg; Werner H. Stemer; Ralph E. Locher

(57) ABSTRACT

A delivery for a sheet-processing machine includes a sheet brake for braking processed sheets from a processing speed to an output speed, a sheet conveyor for transporting the processed sheets in a conveying direction at the processing speed and for transferring the processed sheets to the sheet brake, and a body defining a gap which, during operation, is connected to a vacuum generator and over which the sheets are pullable by the sheet conveyor for smoothing the sheets before they are transferred to the sheet brake, the gap being formed at the sheet brake; and a sheet-processing machine, more particularly, a printing machine, including the delivery.

6 Claims, 4 Drawing Sheets

DELIVERY FOR A SHEET-PROCESSING MACHINE WITH A BRAKING AND SMOOTHING MACHANISM

BACKGROUND OF THE INVENTION

Field of the Invention

The invention relates to a delivery for a sheet-processing machine, especially a printing machine, including a sheet brake for braking processed sheets from a processing speed to an output speed, a sheet conveyor for transporting the processed sheets in a conveying direction at the processing speed and for transferring the processed sheets to the sheet brake, and structure forming a gap which, during operation, is connected to a vacuum generator and over which the sheet conveyor pulls the sheets for smoothing them before they are transferred to the sheet brake, and also to a sheet-processing machine, especially a printing machine, equipped with the delivery.

A delivery of the foregoing type is disclosed in published Swiss Patent Document CH 611 579 A5 which describes a subassembly by which, directly after the processed sheets have been smoothed out, the sheets are braked. This subassembly is formed with two gaps following one another in the processing direction and, during operation, connected to a vacuum generator. A sheet conveyor having grippers which grip a respectively leading edge of the sheets guides the sheets over the two gaps. In order to smooth the sheets out, provision is made for them to be pulled into that gap which is upline of the other of the two gaps, under the action of the vacuum generator, as the sheets sweep over the subassembly, while a respective leading edge of the sheets is positively guided by the grippers. The positive guidance of a respective one of the sheets is discontinued when the sheet leaves the upline gap but still covers the downline gap of the two gaps. With this deliberate discontinuance or cancellation of the positive guidance of the respective sheet, provision is made for braking the latter under the action of the vacuum generator by sucking the sheet against the edges of the downline gap.

This braking process is difficult to control, however, particularly inasmuch as when the respective sheet exposes the upline gap, the pressure relationships in this gap and in the downline gap are changed abruptly.

SUMMARY OF THE INVENTION

It is accordingly an object of the invention to provide a delivery of a sheet-processing machine of the foregoing general type with a subassembly which permits the smoothing and subsequent braking of a respective sheet and which, when the braking process is started, does not cause any change in the pressure relationships created by the vacuum generator. With the foregoing and other objects in view, there is provided, in accordance with one aspect of the invention, a delivery for a sheet-processing machine, comprising a sheet brake for braking processed sheets from a processing speed to an output speed, a sheet conveyor for transporting the processed sheets in a conveying direction at the processing speed and for transferring the processed sheets to the sheet brake, and a body defining a gap which, during operation, is connected to a vacuum generator and over which the sheets are pullable by the sheet conveyor for smoothing the sheets before they are transferred to the sheet brake, the gap being formed at the sheet brake.

In accordance with another feature of the invention, the sheet brake includes a rotating body having a cylindrical outer face which, during operation, rotates positively at a peripheral speed lower than the processing speed, forms with the outer face thereof a first edge of the gap, which is at a downline location with respect to the conveying direction, and pulls a respective sheet, which is transferred to the sheet brake and braked, over the gap in the conveying direction.

In accordance with a further feature of the invention, a second edge defining the gap is formed on a component that is stationary during operation, the second edge being upline from the first edge with respect to the conveying direction.

In accordance with an added feature of the invention, the delivery includes a further cylindrical rotating body which, with a cylindrical outer face thereof, forms a second edge of the gap, the second edge being disposed upline from the first edge with respect to the conveying direction, the two rotating bodies having identical rotational movements during operation.

In accordance with an additional feature of the invention, the cylindrical rotating body forming the first edge is formed as a hollow body with an outer jacket having apertures formed therein and communicating with the interior of the hollow body.

In accordance with another aspect of the invention, there is provided a sheet-processing machine, including a delivery, comprising a sheet brake for braking processed sheets from a processing speed to an output speed, a sheet conveyor for transporting the processed sheets in a conveying direction at the processing speed and for transferring the processed sheets to the sheet brake, and a body defining a gap which, during operation, is connected to a vacuum generator and over which the sheets are pullable by the sheet conveyor for smoothing the sheets before they are transferred to the sheet brake, the gap being formed at the sheet brake.

In accordance with a concomitant aspect of the invention, there is provided a printing machine, including a delivery, comprising a sheet brake for braking processed sheets from a processing speed to an output speed, a sheet conveyor for transporting the processed sheets in a conveying direction at the processing speed and for transferring the processed sheets to the sheet brake, and a body defining a gap which, during operation, is connected to a vacuum generator and over which the sheets are pullable by the sheet conveyor for smoothing the sheets before they are transferred to the sheet brake, the gap being formed at the sheet brake.

Thus, in order to achieve the objective of the invention, the gap provided in the delivery described in the introduction hereto for smoothing a respective sheet is formed at the sheet brake. To this extent, this gap is given a dual function, because, under the action of the vacuum generator, it smoothes the respective sheet positively guided by the sheet conveyor by pulling the sheet into the gap and, after the sheet has been released by the sheet conveyor, the gap continues to remain as a vacuum chamber that is covered by the respective sheet, with the effect that the released sheet is pressed against the edges defining the gap by a vacuum prevailing in the gap and, in the process, is braked.

Furthermore, this dual function also leads to this extent to a simpler construction of the subassembly serving to smooth and brake the sheets, than that required by just a single gap for smoothing and braking.

According to a development, provision is made for the sheet brake to comprise a rotating body having a cylindrical outer face which, during operation, rotates positively at a peripheral speed lower than the processing speed, forms with the outer face a first edge of the gap, which is downline with respect to the conveying direction, and pulls a respective sheet, which is transferred to the sheet brake and braked, over the gap in the conveying direction.

Assurance is therefore provided that a respective sheet is not braked to a standstill before it has left the sheet brake.

The reason for this is that, in the aforementioned development, the rotating body forming the first edge of the gap exerts a forward drive force directed in the processing direction on the braked sheet, in spite of the braking action of the sheet brake.

Although, in the aforementioned development, the sheet brake has a braking element in the form of the rotating body forming the first edge, it has a greater braking action than a conventional sheet brake, disclosed for example by the published German Patent Document DE 196 16 423 C2, having a braking element formed as a rotating body, in the outer cylindrical face of which there terminate suction openings which, during operation, successively communicate with a vacuum generator and through which, in particular in the case of relatively stiff sheets, a given amount of unwanted air flows. The aforementioned greater braking action in the case of the subject of the invention results from a relatively large area, necessitated by the gap, which is covered by the sheet and is under a vacuum.

According to a first refinement of this development, a second edge of the gap, which is upline from the first edge, is formed on a component that is stationary during operation. overall, this therefore results in an extremely simple subassembly for smoothing and braking the sheets.

Another refinement of the development is distinguished by a further cylindrical rotating body which, with the outer face thereof, forms a second edge of the gap, which is upline from the first edge with respect to the conveying direction, and the two rotational bodies have identical rotational movements during operation.

In this case, the further rotating body also exerts a forward drive force on a respectively braked sheet. This ensures that the respective sheet, after the latter has been braked, still experiences a forward drive force on the part of the sheet brake, even under such frictional relationships at the contact points between the edges of the gap and the sheet wherein a frictional force acting upon the sheet from the second edge of the gap exceeds the forward drive force which the sheet experiences from the rotating body forming the first edge.

In a further refinement of the development, the rotating body forming the first edge is formed as a hollow body with an outer surface which has apertures formed therein and communicating with the interior of the hollow body.

To this extent, this refinement provides a further reinforcement of the braking action, because a respective sheet makes contact with the rotating body forming the first edge along a relatively large wrap angle, and therefore brings about an enlargement of the perpendicular force which acts between the sheet and the rotating body.

Furthermore, a subassembly constructed in accordance with the invention for smoothing and braking a respective sheet requires a relatively small installation space, it needs only a single vacuum generator and makes it possible to dispense with additional measures which are necessary, for example, in the case of the sheet brake disclosed by the aforementioned published German Patent Document DE 196 16 423 C2, to produce the first contact between a respective sheet and the braking element. Instead, it is sufficient to bring about contact between the sheet and the edges of the gap which is necessary for smoothing the sheet. However, this can be implemented by a single blast or blown-air curtain directed onto the upper side of a respective sheet in the vicinity of the gap.

Other features which are considered as characteristic for the invention are set forth in the appended claims.

Although the invention is illustrated and described herein as embodied in a delivery for a sheet-processing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
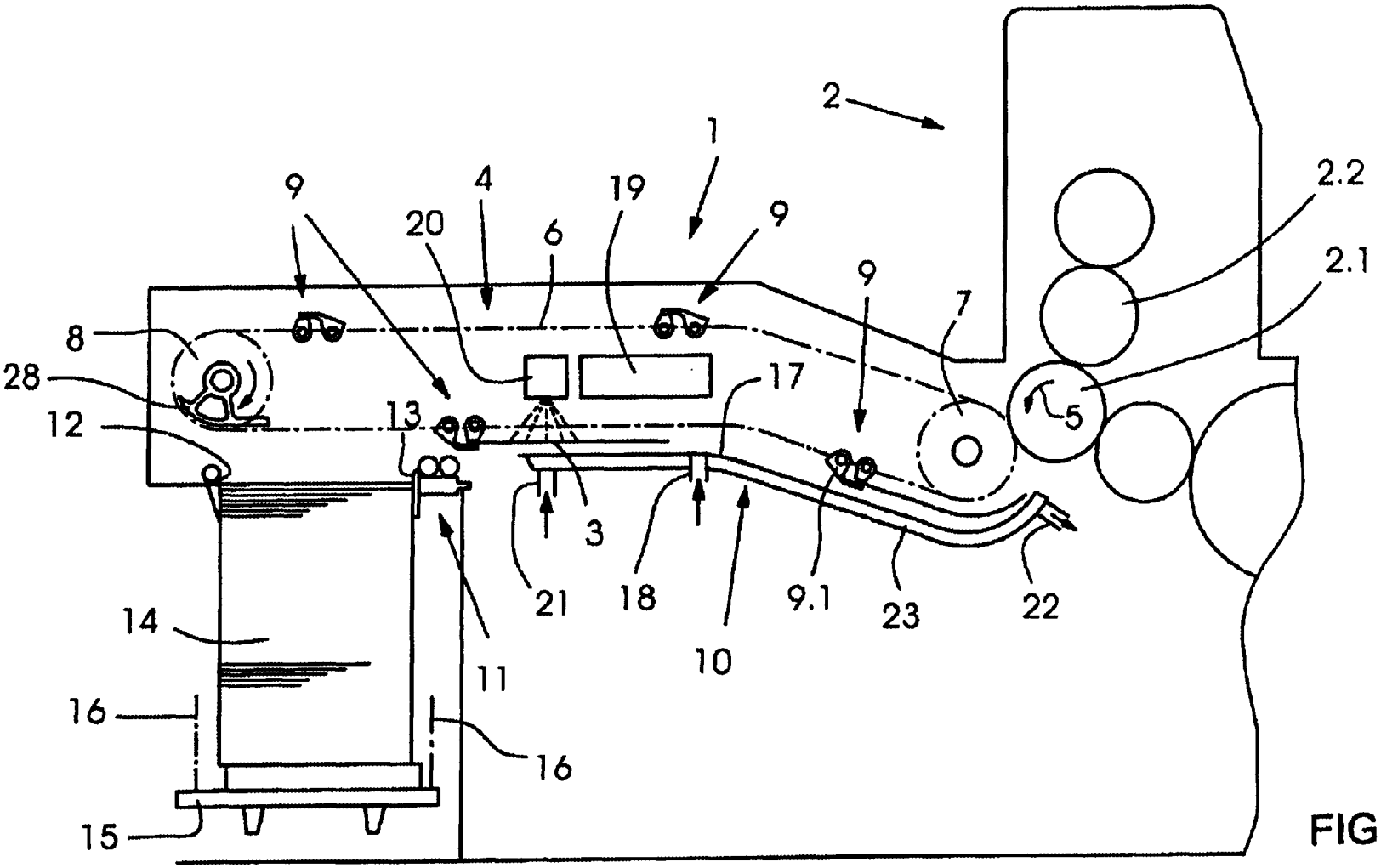
FIG. 1 is a fragmentary diagrammatic side elevational view of a sheet-processing printing machine, showing the delivery thereof, which is constructed in accordance with the invention.

Referring now to the drawings and, first, particularly to FIG. 1 thereof, there is shown therein a delivery 1 following a last processing station of a sheet-processing rotary printing machine 5. Such a processing station may be a printing unit or a post-treatment unit, such as a varnishing unit. In the example at hand, the last processing station is a printing unit 2 operating with the offset process and having an impression cylinder 2.1. The latter carries a respective sheet 3 in a processing direction indicated by a direction-of-rotation arrow 5 through a printing nip between the impression cylinder 2.1 and a blanket cylinder 2.2 co-operating therewith, and subsequently transfers the sheet 3 to a sheet conveyor 4 while opening grippers arranged on the impression cylinder 2.1 and provided for gripping the sheet 3 at a gripper edge located at the leading end of the respective sheet 3. The sheet conveyor 4 includes two conveyor chains 6, one of which, respectively, revolves along a respective side wall of the delivery 1 during operation. A respective conveyor chain 6 loops around one of two synchronously driven drive sprockets 7, respectively, the axes of rotation of which are aligned with one another and, in the example at hand, the respective chain is guided over a deflection or reversing sprocket wheel 8, respectively, located downline of the drive sprockets 7 with respect to the processing direction. Between the two conveyor chains 6, there extend gripper systems 9 which are carried by the conveyor chains 6 and have grippers 9.1 which pass through gaps between the grippers arranged on the impression cylinder 2.1 and, in so doing, accept a respective sheet 3 by gripping the aforementioned gripper edge at the leading end of the sheet 3 directly before the grippers arranged on the impression cylinder 2.1 open, then transport the sheet over a sheet guide device 10 to a sheet brake 11 and open thereat in order to transfer the sheet 3 to the sheet brake 11. The latter imparts to the sheet a deposition speed, reduced with respect to the processing speed, and after reaching the deposition speed, releases the sheet, so that a respective, now retarded sheet 3, finally encounters leading-edge stops 12 and, being aligned on the latter and on trailing-edge stops 13 located opposite thereto, forms together with preceding and/or following sheets 3 a pile or stack 14, which can be lowered by a lifting mechanism to the same extent to which the pile or stack 14 grows. Of the lifting mechanism, FIG. 1 reproduces only a platform 15 carrying the pile or stack 14, and lifting chains 16 which carry the platform 15 and are shown in phantom.

Along their paths thereof between the drive sprockets 7, on the one hand, and the deflection sprockets 8, on the other hand, the conveyor chains 6 are guided by chain guide rails, which therefore determine the chain tracks of the chain strands or runs. In the illustrated example, the sheets 3 are transported by the lower chain strand in FIG. 1. That section of the chain track through which the chain strand passes is followed by a sheet guide surface 17 facing towards it, the surface 17 being formed on the sheet guide device 10. Between the sheet guide surface 17 and the sheet 3, respectively, guided thereover, a supporting air cushion is preferably formed during operation. For this purpose, the sheet guide device 10 is equipped with blast or blown-air nozzles which open into the sheet guide surface 17, FIG. 1 illustrating only one as representative of all thereof, and providing a symbolic representation in the form of the nozzle 18.

In order to prevent the mutual sticking or cohesion of the printed sheets 3 in the pile or stack 14, a dryer 19 and a powdering device 20 are provided on the path of the sheets 3 from the drive sprockets 7 to the sheet brake 11.

In order to avoid excessive heating of the sheet guide surface 17 by the dryer 19, a coolant circuit is integrated into the sheet guide device 10, which is indicated symbolically in FIG. 1 by an inlet nozzle 21 and an outlet nozzle 22 on a coolant trough 23 associated with the sheet guide surface 17.

Figure 2:
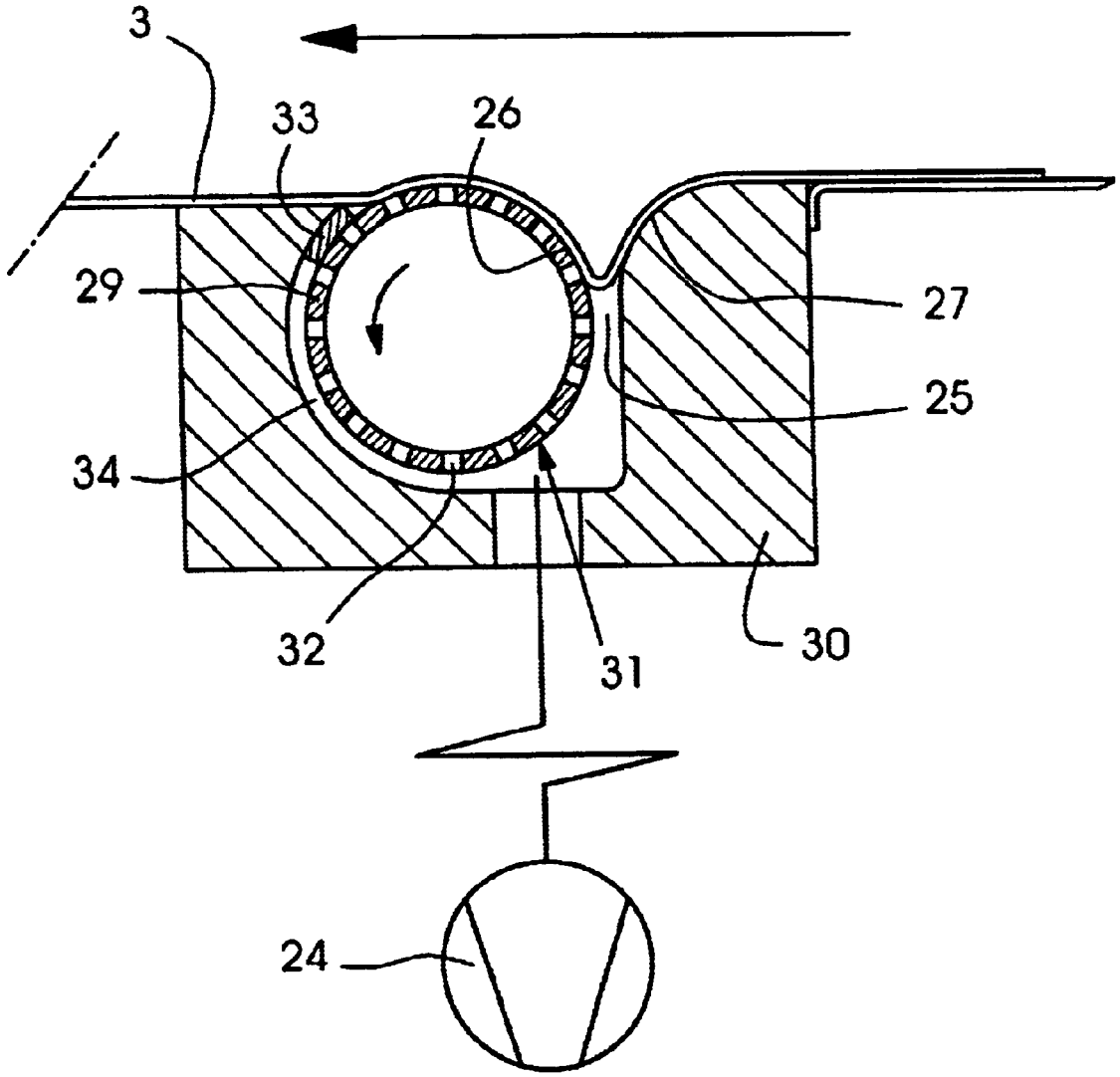
FIG. 2 is a diagrammatic cross-sectional view of a subassembly for smoothing and braking a respective sheet, a gap-defining edge formed on a component thereof that is stationary during operation being located upline with respect to a sheet-conveying direction.

FIG. 2 reproduces one configuration of the sheet brake. This constitutes a subassembly which, in addition to the braking of the sheets 3 explained hereinafter, is also provided for smoothing them out. For this purpose, a gap 25 which, during operation, is connected to a vacuum generator 24, is provided between a first edge 26, located downline from a second edge 27 with respect to the conveying direction provided by the lower strands or runs of the conveyor chains 6 (note FIG. 1), the second edge 27 being thus upline from the first edge 26 and being integrated into the sheet brake. A respective sheet 3 guided along the lower strands of the conveyor chains 6 by one of the gripper systems 9, passes into a region above the sheet brake 11 before the corresponding grippers 9.1 are opened, and is subject thereat to the suction effect prevailing in the gap 25 and forming on the sheet 3 a bead which projects into this gap 25 and migrates upline along the sheet 3 while the grippers 9.1 of a corresponding gripper system 9 are pulling the sheet 3 downline over the gap 25. A smoothing effect is thereby produced on the sheet 3.

During this procedure, i.e., as long as the grippers 9.1 pull the sheet 3, the sheet brake 11 does not develop any braking action. Although, during this time, the sheet 3 has contact with the edges 26 and 27 formed at the sheet brake 11, no transfer of the sheet 3 to the sheet brake 11 has yet taken place, in the sense which is understood that the braking action thereof has started.

The transfer takes place as soon as the grippers 9.1 pulling the sheet 3 over the gap 25 and held closed under spring tension are opened.

Arranged on a respective gripper system 9 is a roller lever (not illustrated), which is operated by a control cam 28 provided in the region of the deflection sprockets 8 with the effect that it opens the grippers 9.1 counter to the spring tension (note FIG. 1). When the grippers 9.1 are opened, the transfer of a respective sheet 3 to the sheet brake 11 then takes place, and the latter then develops the braking action thereof.

In the case of the configuration of the sheet brake 11 according to FIG. 2, the sheet brake 11 shown therein includes a rotating body 29 which, with the outer face thereof, forms the first and downline edge 26 of the gap 25. The second and upline edge 27 is in this case formed on a component that is stationary during operation. The rotating body 29 is operatively connected to a drive (not illustrated here) and, during operation, can be driven by the latter so it rotates at a peripheral speed which is lower than the processing speed corresponding to the peripheral speed of the conveyor chains. The grippers 9.1 are opened at a time at which the gap 25 is at least still covered by a trailing section of the sheet 3. The frictional forces between the sheet 3 and the edges 26 and 27 caused by this, and also already caused during the preceding smoothing of the sheet 3, as a result of the vacuum in the gap 25, then retard the sheet 3 if there is an adequate length of its trailing section used for braking and if there are appropriate frictional and vacuum relationships, until the speed of the sheet has fallen to the peripheral speed of the rotating body 29 before the sheet 3 has left the rotating body 29.

For this case, the sheet brake 11 is constructed so that the sheet 3 is transported onwardly at this speed with the aid of the rotating body 29. For this purpose, the frictional relationships between the sheet 3 and the rotating body 29, on the one hand, and the sheet 3 and the edge 27, on the other hand, are selected so that the rotating body 29 exerts a greater frictional force on the sheet 3 than does the edge 27.

In the case of the configuration according to FIG. 2, such frictional relationships are put into effect by forming the rotating body 29 as a hollow body with an outer jacket or casing 31 which has apertures 32 formed therein and communicating with the interior of the hollow body 29. As a result, a respectively longer section of the sheet 3 is pressed against the rotating body 29 than against the edge 27. The normal or perpendicular force between the edge 27 and the rotating body 29, which is increased by comparison with the normal force between the edge 27 and the sheet 3, therefore ensures the transport of the sheet 3 by the rotating body 29 counter to the action of the frictional force between the sheet 3 and the edge 27, in the form wherein the rotational body 29 pulls the braked sheet 3 over the gap in the conveying direction.

In the exemplary embodiment according to FIG. 2, the rotating body 29 is inserted into a recess in the component 30 that is stationary during operation and, on a portion of the outer face thereof which is downline with respect to the conveying direction represented by the associated horizontal arrow, a seal 33 which acts between the component 30 and the rotating body 29 is provided and arranged so that the braked sheet 3 is not pulled into an annular gap 34 present in this embodiment between the component 30 and the rotating body 29. This has the effect of counteracting any potential damage to the sheets 3.

Figure 3:
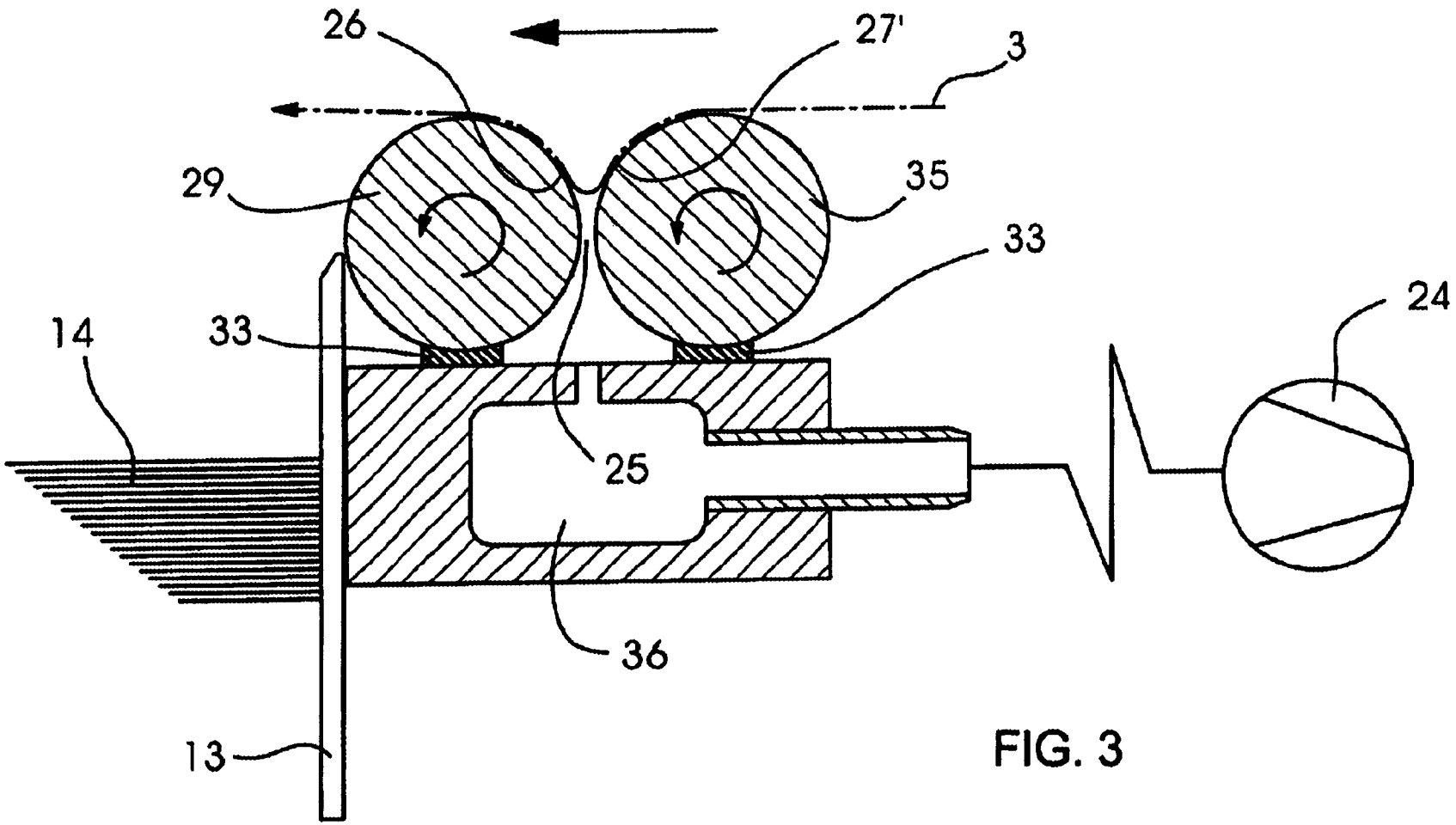
FIG. 3 is an enlarged fragmentary view of FIG. 1 showing an alternative subassembly to that of FIG. 2 for smoothing and braking a respective sheet, two edges defining the gap being formed by rotating bodies which rotate positively during operation.

According to the alternative embodiment shown in FIG. 3, a second edge 27' of the gap 25, which is upline with respect to the conveying direction represented by the horizontal arrow, is formed by an outer face of a further rotating body 35. In this configuration, the two rotating bodies 29 and 35 execute like rotational movements. During operation, the gap 25 is connected via a suction chamber 36 to a vacuum generator 24, and a space forming the gap 25 between the rotating bodies 29 and 35 is further bounded by seals 33, which act between the rotating bodies 29 and 35, on the one hand, and the suction chamber 36, on the other hand.

Figure 4:
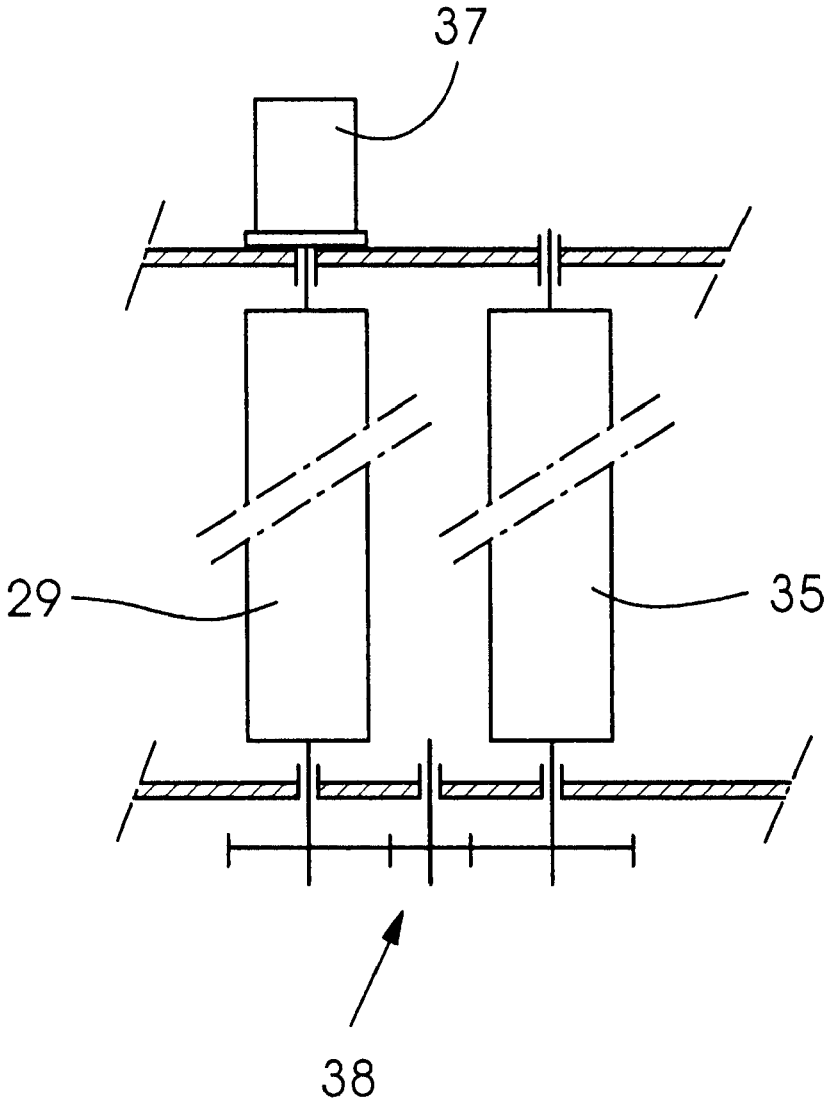
FIG. 4 is a diagrammatic top plan view, partly in section, of an exemplary embodiment of a drive for rotating the rotating bodies according to FIG. 3.

According to FIG. 4, the two rotating bodies 29 and 35 are driven, for example, by a motor 37 and a gear transmission 38, the latter, during operation, providing identical rotational movements of the two rotating bodies 29 and 35. These rotational movements are performed at mutually equal peripheral speeds, which are lower than the processing speed.

In this configuration of the subassembly provided for smoothing and braking the sheets 3, both rotating bodies 29 and 35 constitute transport rollers for the sheets 3 which, after the grippers 9.1 have been opened, have been braked to the peripheral speed of the rotating bodies 29 and 35. This configuration proves to be particularly advantageous inasmuch as reliable transport of the braked sheets 3 in the direction of the pile or stack 14 is ensured even when, between the rotating body 29 which is downline with respect to the conveying direction and the respective sheet 3, smaller frictional forces are supposed to act than between the latter and the rotating body 35 which is upline. Any changes to corresponding frictional values which may be necessitated by operations therefore have no influence on the process of smoothing and braking the sheets 3 and on the output thereof to the pile or stack 14.

We claim:

1. A delivery for a sheet-processing machine, comprising:

a sheet brake for braking processed sheets from a processing speed to an output speed;

a sheet conveyor for transporting the processed sheets in a conveying direction at the processing speed and for transferring the processed sheets to said sheet brake; and a sheet smoothing device defining a gap having a declining edge and an ascending edge disposed, with reference to the conveying direction, downstream from said declining edge, said gap, during operation, being connected to a vacuum generator, said sheet conveyor pulling the sheets over said gap for smoothing the sheets;

said sheet brake including a rotating body having a cylindrical outer face, said rotating body, during operation, rotating positively at a peripheral speed lower than the processing speed, said rotating body with said outer face thereof forming said ascending edge of said gap and pulling a respective sheet transferred to said sheet brake and smoothed over said gap in the conveying direction;

said gap being disposed, with reference to the conveying direction, upstream from said rotating body.

2. The delivery according to claim 1, wherein said declining edge of said gap is formed on a component that is stationary during operation.

3. The delivery according to claim 1, including a further cylindrical rotating body, with a cylindrical outer face thereof, forming said declining edge of said gap, said two rotating bodies having identical rotational movements during operation.

4. The delivery according to claim 1, wherein said cylindrical rotating body forming said ascending edge is formed as a hollow body with an outer jacket having apertures formed therein and communicating with an interior of said hollow body.

5. A sheet-processing machine including a delivery, the delivery comprising:

a sheet brake for braking processed sheets from a processing speed to an output speed;

a sheet smoothing device defining a gap having a declining edge and an ascending edge disposed, with reference to the conveying direction, downstream from said declining edge, said gap, during operation, being connected to a vacuum generator, said sheet conveyor pulling the sheets over said gap for smoothing the sheets;

said sheet brake including a rotating body having a cylindrical outer face, said rotating body, during operation, rotating positively at a peripheral speed lower than the processing speed, said rotating body with said outer face thereof forming said ascending edge of said gap and pulling a respective sheet transferred to said sheet brake and smoothed over said gap in the conveying direction;

said gap being disposed, with reference to the conveying direction, upstream from said rotating body.

6. A printing machine including a delivery, the delivery comprising:

a sheet brake for braking processed sheets from a processing speed to an output speed;

a sheet smoothing device defining a gap having a declining edge and an ascending edge disposed, with reference to the conveying direction, downstream from said declining edge, said gap, during operation, being connected to a vacuum generator, said sheet conveyor pulling the sheets over said gap for smoothing the sheets;

said sheet brake including a rotating body having a cylindrical outer face, said rotating body, during operation, rotating positively at a peripheral speed lower than the processing speed, said rotating body with said outer face thereof forming said ascending edge of said gap and pulling a respective sheet transferred to said sheet brake and smoothed over said gap in the conveying direction;

said gap being disposed, with reference to the conveying direction, upstream from said rotating body.

* * * * *